US006097417A

United States Patent [19]

Richardson, Jr. et al.

[11] Patent Number: 6,097,417

[45] Date of Patent: Aug. 1, 2000

[54] VACUUM SYSTEM FOR REMOVING ABLATED PARTICLES FROM MEDIA MOUNTED IN AN INTERNAL DRUM PLATESETTER

[75] Inventors: Donald B. Richardson, Jr., Atkinson, N.H.; Robert D. Olenio, North Andover, Mass.; Jeffrey Knox, Lynnfield, Mass.; Nicholas Stefanidakis, Milton, Mass.; Behrouz Abedian, Lincoln, Mass.

[73] Assignee: Agfa Corporation, Wilmington, Mass.

[21] Appl. No.: 09/157,849

[22] Filed: Sep. 21, 1998

[51] Int. Cl.[7] ..... B41J 2/47

[52] U.S. Cl. ..... 347/225; 347/262; 347/264; 346/125; 346/132; 505/410; 505/412

[58] Field of Search ..... 347/262, 264, 347/225, 187; 346/125, 132; 430/332, 306; 219/121.68; 285/114; 505/410, 412

[56] References Cited

U.S. PATENT DOCUMENTS

| | | | |
|---|---|---|---|
| 5,286,068 | 2/1994 | Wiebe | 285/114 |
| 5,574,493 | 11/1996 | Sanger et al. | 347/262 |
| 5,654,125 | 8/1997 | Fan et al. | 430/306 |
| 5,780,806 | 7/1998 | Ferguson et al. | 219/121.68 |

FOREIGN PATENT DOCUMENTS 0882582 6/1998 European Pat. Off. .

OTHER PUBLICATIONS

Marketing Catalog entitled "Selectset Avantra Product and Technology Overview" © 1998 by Bayer Corporation.

*Primary Examiner*—N. Le
*Assistant Examiner*—Hai C. Pham
*Attorney, Agent, or Firm*—Robert A. Sabourin

[57] ABSTRACT

A vacuum system can remove ablated particles from an internal drum platesetter which has a drum for supporting a photosensitive medium, a carriage moveable in a direction parallel to a longitudinal axis of the drum, and a laser mounted onto the moveable carriage for generating a beam to create an image on the medium during movement of the carriage, the beam ablating particles of the medium during creation of the image. The vacuum system includes: a vacuum head fixedly attached to the moveable carriage, and having at least one chamber for receiving the ablated particles through a slot located proximate to a periphery of the vacuum head; and an exhaust system connected to the vacuum head and including ductwork, at least one fan and at least one filter, for extracting the ablated particles from the at least one chamber of the vacuum head. The vacuum system also includes a hose capable of expanding and retracting in length to accommodate the movement of the vacuum head, and an internal duct support system for supporting the hose during expansion and retraction to prevent sagging of the hose. A swivel connection can be located at one or both ends of the hose to accommodate rotational movement of the hose during expansion and retraction.

8 Claims, 3 Drawing Sheets

VACUUM SYSTEM FOR REMOVING ABLATED PARTICLES FROM MEDIA MOUNTED IN AN INTERNAL DRUM PLATESETTER

BACKGROUND OF THE INVENTION

This invention relates generally to removal of laser ablated particles in imagesetters and platesetters for the prepress printing industry, and more specifically to a vacuum system for removing the ablated particles away from a film or printing plate immediately after imaging thereon with an electromagnetic waveform.

In the prepress printing industry, it is well known that a substrate characterized as either a film or a printing plate (hereinafter jointly referred to as a "plate") can have an image transferred thereto by selectively "burning" sections of a thermally-sensitive surface of the plate with an electromagnetic waveform. This method of imaging a plate is generally referred to as thermal imaging. Typically, the power necessary for such image transfer is attained through the use of a laser light source for emitting the electromagnetic waveform. The specific chemical makeup of the plate will dictate the required characteristics of the light source which are necessary to adequately bum an image into the plate at the required depth. Alternatively, a plate can be manufactured having the appropriate chemical makeup to allow imaging with a predetermined light source.

In an internal drum imagesetter or platesetter (hereinafter jointly referred to as "platesetter"), a plate is positioned along the internal cylindrical surface of the drum prior to imaging. The drum and surrounding components create an internal drum chamber. The air space above the plate and within the imager is closed within the internal drum chamber to prevent contamination of the plate, the internal surface of the drum, optics and other components from dust, dirt and other contaminants.

When a laser beam is transmitted to the thermally-sensitive surface of the plate positioned for imaging within the platesetter, laser ablation occurs. Laser ablation refers to a high-yield photon sputtering process which effectively removes material from the thermally-sensitive surface of the plate. The material effectively explodes from the surface of the plate, resulting in a gaseous plume of smoke and debris. The ablated materials will thereafter disperse throughout the air in the internal drum chamber and will settle onto the plate, the internal drum surface, optics and other components touching the air space of the internal drum chamber. Laser ablation and plume formation is discussed in detail, for instance, in "Laser Ablation And Desorption" edited by John C. Miller and Richard F. Haglund, Vol. 30, 1998 by Academic Press, herein incorporated by reference in its entirety to provide supplemental background information on laser ablation which is helpful but not essential in appreciating the applications of the present invention.

U.S. Pat. No. 5,574,493 issued Nov. 12, 1996 to Sanger et al. describes a vacuum collection system for use to remove ablated materials from an external drum imager which uses a dye-ablation printing process. The system includes a cylindrical lens barrel which carries an imaging lens system for a laser and a vacuum tube attached to the lens barrel. The vacuum tube is positioned so as to be on the lateral side of an orifice box away from material previously written. This draws the ablated material over unwritten portions of the medium and reduces the problem of blow-back of contaminates onto the previously written surface. In this system, if ablated material is drawn over a previously written surface, a substantial portion of the ablated materials (i.e. blow-back) will stick to the medium. Sanger et al. also teaches that build-up of ablated materials in the vacuum chamber is inhibited by either applying heat or a solvent to the vacuum chamber.

Sanger's method is limited to use with an external drum imager with a rotating drum, whereby both the laser system and the vacuum collection system are stationary. Moreover, the vacuum tube for removing ablated particles precedes the laser along the imaging path, so that the area of the medium to be imaged is cleaned by vacuuming prior to imaging.

SUMMARY OF THE INVENTION

A vacuum system can remove ablated particles from an internal drum platesetter which has a drum for supporting a photosensitive medium, a carriage moveable in a direction parallel to a longitudinal axis of the drum, and a laser mounted onto the moveable carriage for generating a beam to create an image on the medium during movement of the carriage, the beam ablating particles of the medium during creation of the image. The vacuum system includes: a vacuum head fixedly attached to the moveable carriage, and having at least one chamber for receiving the ablated particles through one or more openings located proximate to a periphery of the vacuum head; and an exhaust system connected to the vacuum head and including ductwork, at least one fan and at least one filter, for extracting the ablated particles from the at least one chamber of the vacuum head. The vacuum system also includes a hose capable of expanding and retracting in length to accommodate the movement of the vacuum head, and an internal duct support system for supporting the hose during expansion and retraction to prevent sagging of the hose. A swivel connection can be located at one or both ends of the hose to accommodate rotational movement of the hose during expansion and retraction.

It is an object of the present invention to provide a vacuum system for removing ablated particles from an internal drum imaging system having a stationary drum a moveable laser, and a moveable vacuum head which trails behind the laser beam during imaging. It is another object to provide ductwork for the vacuum system including a hose capable of expanding and retracting in length in order to accommodate movement of the vacuum head. It is yet another object to provide support to prevent sagging of the hose during expansion and retraction. It is yet another object to allow rotational movement of the hose during expansion and retraction. These and other objects are realized from the following detailed description when read in conjunction with the drawings.

BRIEF DESCRIPTION OF THE DRAWINGS

The aforementioned aspects and other features of the invention are described in detail in conjunction with the accompanying drawings in which the same reference numerals are used throughout for denoting corresponding elements and wherein.

DETAILED DESCRIPTION OF THE PREFERRED EMBODIMENTS

Figure 1:
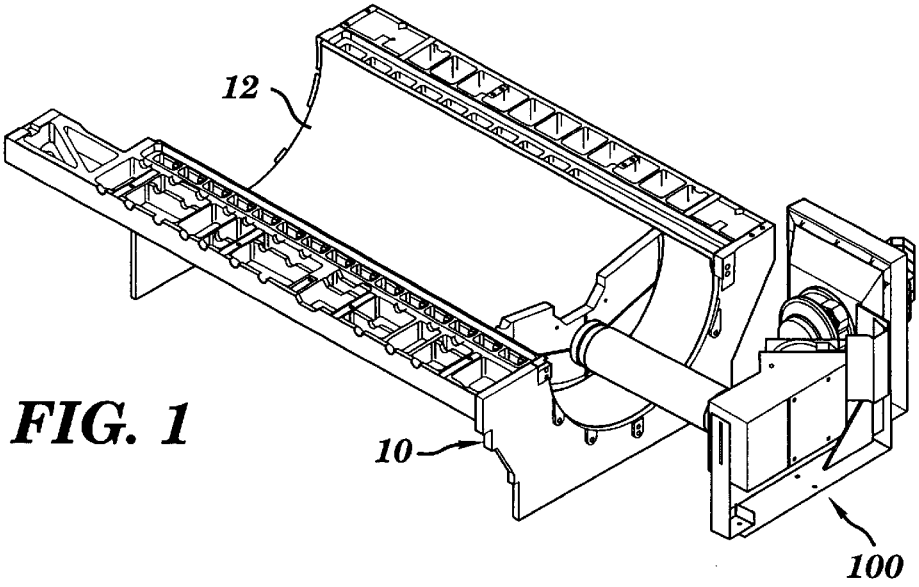
FIG. 1 is a partial cutout perspective view of components of an internal drum platesetter including a first embodiment of a vacuum system according to the present invention.

FIG. 1 is a partial cutout perspective view of components of an internal drum platesetter including a first embodiment of a vacuum system 100 according to the present invention. The figure shows a drum 10 having an internal cylindrical drum surface 12 upon which a substrate or printing plate 28 having a thermally-sensitive surface 30 (see FIG. 2) is aligned. Internal drum platesetters are well known in the art. For instance, Agfa Division of Bayer Corporation located at 200 Ballardvale Street in Wilmington, Mass. manufactures internal drum platesetters such as the SelectSet Avantra® series which features internal drum design as described in the SelectSet Avantra, Product and Technology Overview marketing brochure ©1998 by Agfa, herein incorporated by reference in its entirety to provide supplemental background information about internal drum imagers which is helpful but not essential in appreciating the applications of the present invention.

Figure 2:
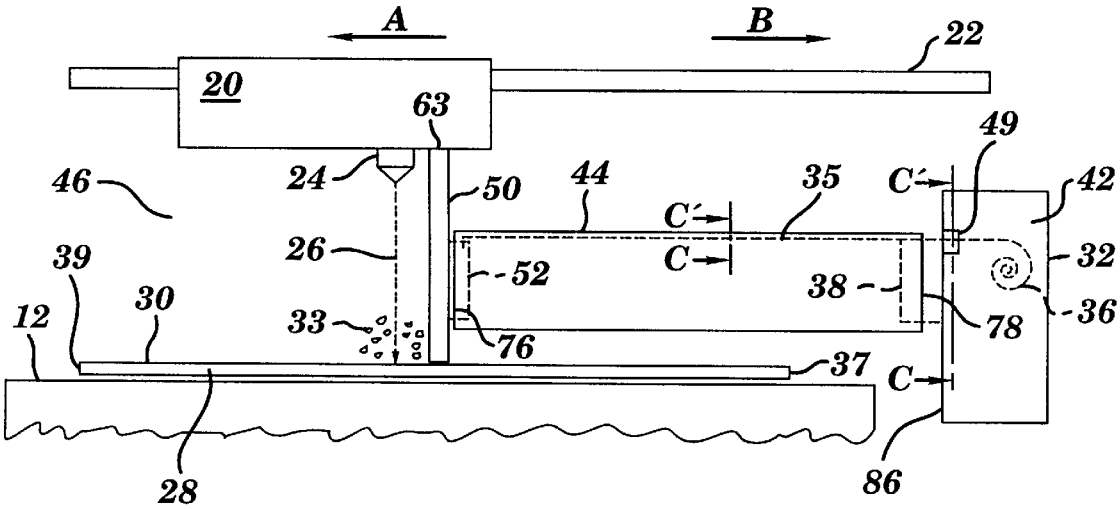
FIG. 2 is partial side cutout view of components of an internal drum platesetter including a second embodiment of a vacuum system according to the present invention.

The operation of one type of platesetter is explained in view of FIG. 2. A carriage 20, having a laser 24 mounted thereon, is mounted on a rail 22. Together these components form a scan assembly. The printing plate 28, which is positioned on the internal drum surface 12, includes a thermally-sensitive surface 30 facing away from the internal drum surface 12. The laser 24 transmits a beam 26 upon the thermally-sensitive surface 30 to burn an image onto the surface 30 in accordance with instructions received from a raster image processor (RIP), computer or other controller (not shown). The image is burned onto the surface 30 while the carriage 20 moves in a direction A along the rail 22. The imaging begins at or near the end 37 of the substrate 28, and is completed at or near the end 39. After the plate 28 is scanned or imaged, the power of the laser 24 is reduced to a non-imaging level, the carriage is returned in a direction B along the rail 22 to its start position, the imaged plate is extracted from the drum, a next plate 28 is positioned on the drum, the power of the laser 24 is increased to an imaging level, and imaging of the next plate 28 again begins at its end 37. A typical scan assembly for an internal drum imaging system may also include a spin mirror or other optical device to direct the laser beam over the thermally-sensitive surface 30, as understood by those skilled in the art. The ablation vacuum system described herein is specifically designed for use with an internal drum platesetter where the imaging beam 26 moves across the thermally-sensitive surface 30 of the plate 28 which is positioned on the internal surface 12 of the stationary drum 10.

As previously noted, laser ablation of the surface 30 will cause debris 33 to dislodge from the surface 30. The ablated particles 33 will form smoke or dust which can collect on any laser optics (such as mirrors, beam deflectors, etc.), on written or unwritten portions of the thermally-sensitive surface 30, on the internal drum surface 12, or on any other components located within, or touching, the air space 46 of the internal drum. The material build-up of the ablated particles 33 can effect the integrity and imaging accuracy of the imaged plate 28. In other words, the deposit of ablated particles on either the written or unwritten portions of the plate 28 upsets the surface smoothness, thickness and material composition of the plate which, in turn, may cause degradation of any image burned thereon. Additionally, smoke generated by the ablation process can interfere with the optical beam 26, changing the intensity, power and/or energy of the beam 26 as transmitted to the surface 30 of the plate 28.

Figure 4:
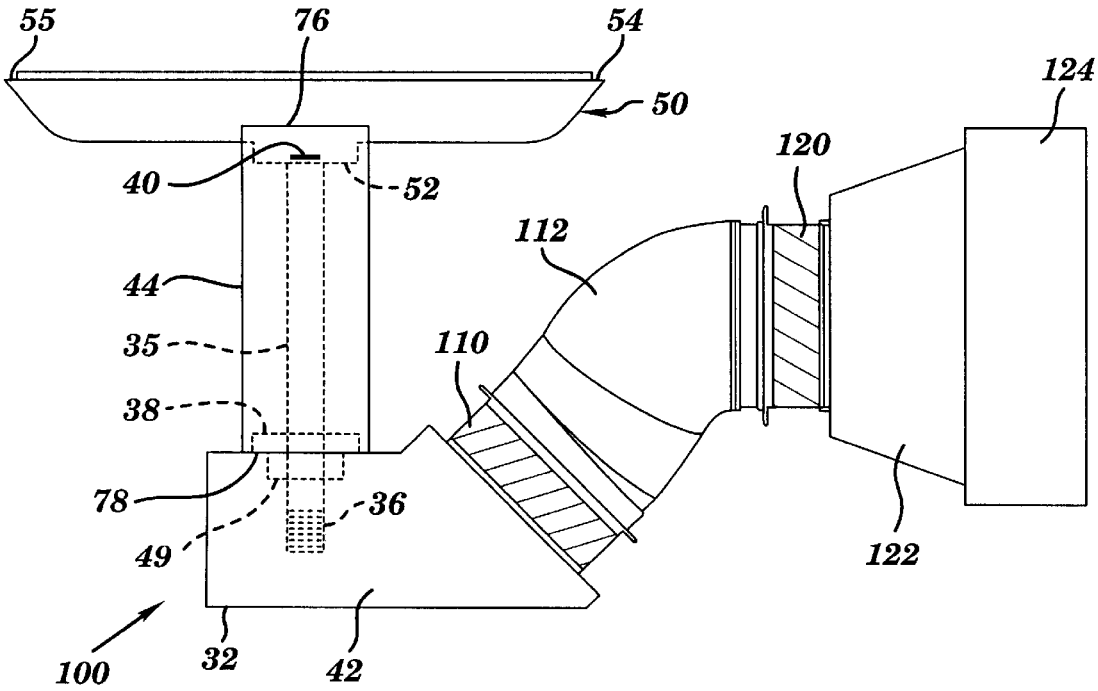
FIG. 4 is a top view of a third embodiment of a vacuum system according to the present invention.

A vacuum system 100, as illustrated by the embodiment of FIG. 4, is useful to remove the ablated particles 33 from the air within the internal drum before the particles 33 have a chance to settle on any surfaces. The vacuum system 100 includes one or more fans 110, 120 which are powered, for instance, by self-contained motors to create suction to remove ablated particles 33 from the internal drum air space 46, and to capture the ablated particles 33 in a filter 124.

Figure 5:
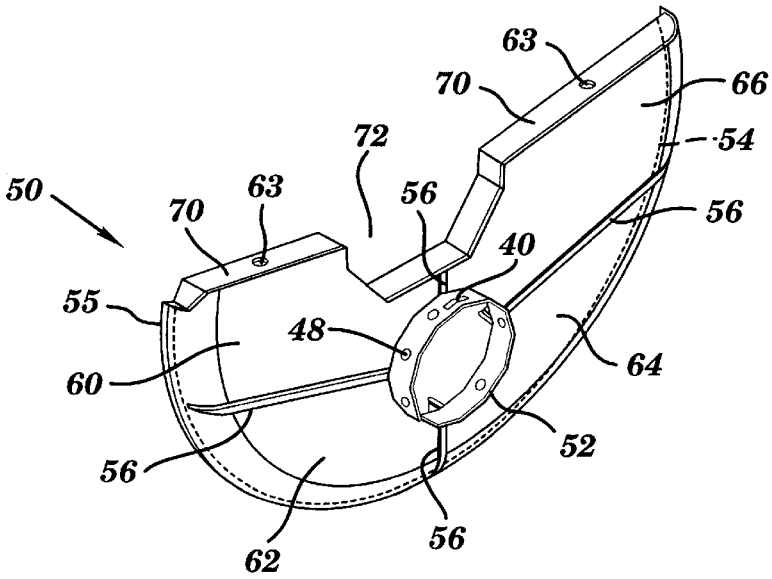
FIG. 5 is a perspective view of one embodiment of a vacuum head according to the present invention.

The vacuum system 100 includes a vacuum head 50 connected to an exhaust system. Numerous designs can be used for the vacuum head 50 for accomplishing the task of removing the ablated particles 33 from the air space 46 within the internal drum. In the broadest sense, the vacuum head 50 requires one or more internal chambers 60, 62, 64, 66 for receiving the ablated particles 33 through one or more openings 54 located proximate to its periphery 55. FIG. 5 illustrates one embodiment shown in perspective view of a shroud type vacuum head 50, which includes: four internal chambers 60, 62, 64 and 66, each separated by inner walls 56; a single slot (i.e. opening) 54 located on or near the periphery 55; and a collar 52 for attachment of the vacuum head 50 to components of the exhaust system. In a preferred embodiment, the vacuum head 50 is shaped so that the periphery 55 follows the curvature of the internal drum surface 12. The vacuum head 50 can be mounted to the carriage 20 in any desirable manner. One example is the use of adhesive, nuts and bolts, screws or rivets via holes 63 located on the upper flat surfaces 70 of the vacuum head 50. Other surfaces of the vacuum head 50 could be used for mounting, or additional mounting brackets and other well known fastening means could be employed, if desired.

The exact design of the vacuum head 50 is dependent upon the tolerances and design requirements of the particular internal drum imaging system with which it is used. The vacuum head 50 of FIG. 5 is one such design which includes an indent 72 located between chambers 60, 66 and opposite upper flat surfaces 70, respectively.

Figure 6A:
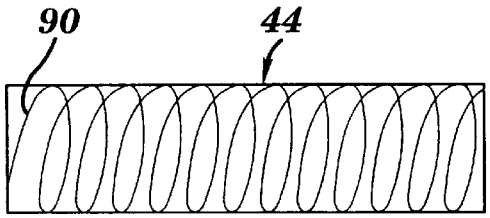
FIG. 6A is a representation of a helical wire support hose.
Figure 6B:
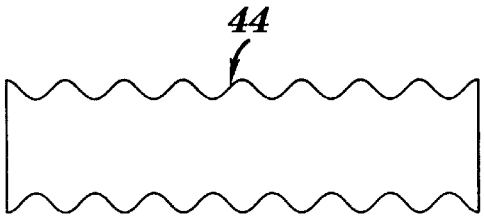
FIG. 6B is a representation of a bellows hose.

In FIG. 2, a flexible, expandable duct or hose 44 is secured at one end 76 to the collar 52 of the vacuum head 50 using a hose clamp, or using adhesive or fasteners such as screws, bolts, rivets, etc. through the fastening holes 48. The expandable duct 44 can be similarly fastened at its other end 78 to a collar 38 protruding from a chamber 42. The duct 44 can alternatively be fastened at either end by any known means, such as by using a snap-on or twist-on mechanism having a quick release feature. Moreover, the hose 44 can be any type of expandable and retractable duct such as a helical wire support hose 44 having a helical spring 90 therein as illustrated in FIG. 6A, or a bellows hose as illustrated in FIG. 6B.

Figure 7A:
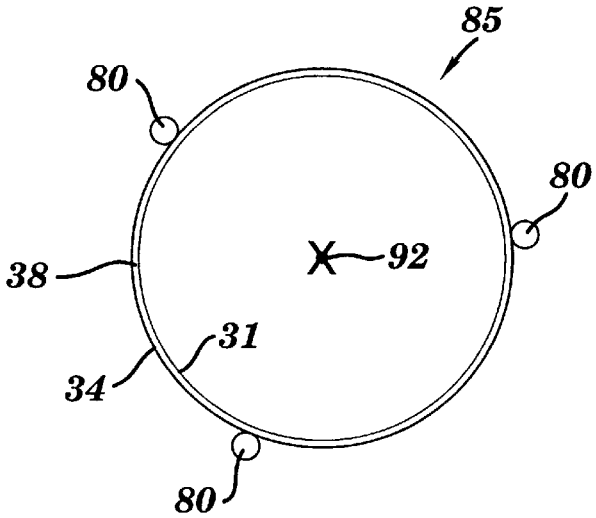
FIG. 7A is a diagrammatical cross-sectional view of a hose rotation mechanism.
Figure 7B:
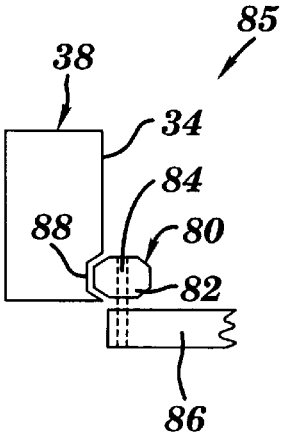
FIG. 7B is a partial side cross-sectional view of the hose rotation mechanicm of FIG. 7A.

In some cases, the hose 44 can be prone to twisting and turning during expansion and retraction. In these cases, a swivel mechanism or hose rotation mechanism 85 (such as the one illustrated in FIGS. 7A and 7B) can be utilized to accommodate the twisting and turning of the hose 44. This swivel mechanism 85 could be used for securing both ends of the hose 44, or for securing only one end (preferably the end connecting to the chamber 42). The swivel mechanism 85 includes a circular collar 38 and preferably three wheel bearings or roller bearings 80. The roller bearings 80 are fixedly secured to the front wall 86 of the chamber 42 via axles 84 about which the wheel portions 82 of the bearings 80 rotate. The bearings 80 interconnect with the collar 38, for instance, via a slot 88 which is machined or molded into the outer surface 34 of the collar 38. The hose 44 is connected to the collar 38 as previously described by a hose clamp or other means so that when, for instance, a helical wire support hose 44 is expanded by movement of the vacuum head 50 away from the chamber 42, the resulting angular force from the expansion of the helical spring 90 will cause the hose 44 and the collar 38 to rotate about the axis 92 of the hose 44. This rotation is facilitated by the interaction between the bearings 80 and the collar 38 along the slot 88. The axis 92 of the hose 44 runs parallel to a longitudinal axis of the internal drum.

Preferably, two of the three roller bearings (more than three bearings can be used if desired) of the swivel mechanism 85 are concentric, meaning that the axis of each bearing is located at the center of the circular wheel 82. One of the roller bearings 80 could be eccentric, meaning that the axis 84 of that bearing 80 could be offset if necessary from the center of the circular wheel 82. An eccentric bearing 80 includes a screw adjustable axis 84 located in a slot on the wheel 82 whereby the relative position of the bearing wheel 82 to the axis 84 can be adjusted to best fit the wheel 82 into the slot 88 of the collar 38.

The chamber 42, a wound spring section 36, a spring support 49 and the collar 38 together form a subassembly 32. One or more fans 110 and 120 are installed along the discharge path for removing the ablated particles 33 from the air space 46 of the platesetter. The exhaust system also includes an air plenum 122 and an air filter 124.

In the above-described embodiment of a vacuum system for removing ablated particles, the ablated particles 33 are removed from the air space 46 of the platesetter by a discharge path which traverses through the opening 54, the vacuum head chambers 60, 62, 64, 66, the hose 44, the chamber 42, the fan 110, the duct 112, the fan 120, the air plenum 122 and the filter 124.

After passing through the filter 124, the air can either be discharged from the platesetter or recirculated therethrough.

Figure 3:
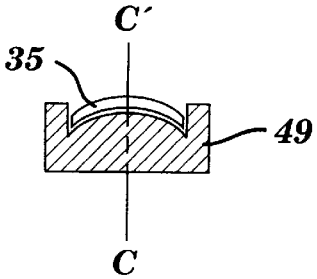
FIG. 3 is a cross-sectional view along line C'–C in FIG. 2 of one embodiment of a spring and spring support for preventing sagging of ductwork according to the present invention.

It is important for the expandable duct or hose 44 to be able to expand fully without any part thereof coming into contact with the internal drum surface 12, or with the thermally-sensitive surface 30 of the printing plate 28. Such contact could cause numerous problems such as contaminating the surfaces 12 and 30, and/or impeding the movement of the vacuum head 50. These problems are prevented using an internal duct support 35 which keeps the flexible duct 44 from sagging and dragging (on either the internal drum surface 12 or the thermally-sensitive surface 30 of the plate 28) when the duct 44 is extended. The flexible duct 44 is supported in one embodiment by a cross rolled and coiled spring 35 which is affixed at one end to the slot 40 of the collar 52 of the vacuum head 50 (see FIG. 2). Alternatively, a flat spring 35 can be used. The spring 35 includes a wound section 36 fixed within the subassembly 32. FIG. 3 is a cross-sectional view of a coiled spring 35 positioned on a spring support 49 so that the convex portion of the spring 35 is facing upwards in relation to both FIGS. 2 and 3. When the duct 44 is extended, the spring 35 is unrolled from the wound spring section 36 over the traveled distance supporting the weight of the duct 44 between the end of the spring fastened in the slot 40, and the spring support 49, thus minimizing duct sag. The spring support 49 which functions both to guide and support the spring 35, is fixedly attached to the subassembly 32.

It is to be understood that the above described embodiments are merely illustrative of the present invention and represent a limited number of the possible specific embodiments that can provide applications of the principles of the invention. For instance, many varieties of flat springs having design and functional characteristics different than those described for the preferred spring 35 above, could be used to support the flexible duct 44. Also, some of the components of the vacuum system could be located external to the platesetter rather than being incorporated within the platesetter as described above. Numerous and varied other arrangements may be readily devised in accordance with the principles of the invention as understood by those having ordinary skill in the art.

What is claimed is:

1. A vacuum system for use in an internal drum platesetter having a drum for supporting a photosensitive medium, a carriage moveable in a direction parallel to a longitudinal axis of the drum, and a laser mounted onto the moveable carriage for generating a beam to create an image on the medium during movement of the carriage, the beam ablating particles of the medium during creation of the image, the vacuum system comprising:

a vacuum head fixedly attached to the moveable carriage, and comprising at least one chamber for receiving the ablated particles through a slot located (i) proximate to or along a periphery of the vacuum head, and (ii) proximate to an internal circumferential surface of the drum, said vacuum head positioned on the carriage behind the beam during imaging, with respect to movement along the longitudinal axis of the drum; and an exhaust system connected to the vacuum head and comprising ductwork, at least one fan and at least one filter, for extracting the ablated particles from the at least one chamber of the vacuum head while the beam is imaging the medium.

2. The vacuum system of claim 1, wherein the ductwork of the exhaust system comprises a hose capable of expanding and retracting in length to accommodate the movement of the vacuum head.

3. The vacuum system of claim 2 further comprising an internal duct support system for supporting the hose during expansion and retraction to prevent sagging of the hose and to prevent the hose from contacting the medium.

4. The vacuum system of claim 3, wherein the internal duct support system comprises a spring connected at a first end proximate to one end of the hose, and at a second end proximate to a spring coil mounted on a fixed support.

5. The vacuum system of claim 2 further comprising a swivel connection located at one or both ends of the hose to accommodate rotational movement of the hose during expansion and retraction.

6. A method for use in an internal drum platesetter having a drum supporting a photosensitive medium, the method comprising the steps of:

transferring an image onto the medium by moving an imaging beam across the medium; and suctioning and removing ablated particles of the imaged medium through a single slot located (i) proximate to or along a periphery of a vacuum head and proximate to an arc defining a circumferential inner surface of the drum, and (ii) directly behind the moving beam during imaging in relation to its movement along a longitudinal axis of the drum.

7. The method of claim 6 wherein the movement of the vacuum head is facilitated by connection of the vacuum head to a duct comprising an internal duct support system for supporting the duct during expansion and retraction to prevent sagging of the duct and to prevent the duct from contacting the medium.

8. The method of claim 7 wherein the internal duct support system comprises a spring connected at a first end proximate to one end of the duct, and at a second end proximate to a spring coil mounted on a fixed support.

* * * * *